US005575149A

United States Patent [19]

Stoychoff

[11] Patent Number: 5,575,149

[45] **Date of Patent: *Nov. 19, 1996**

[54] HYDRAULIC SWING CIRCUIT

[75] Inventor: Terry A. Stoychoff, Garner, Iowa

[73] Assignee: Iowa Mold Tooling Company, Inc., Garner, Iowa

[ * ] Notice: The term of this patent shall not extend beyond the expiration date of Pat. No. 5,499,503.

[21] Appl. No.: 526,493

[22] Filed: Sep. 11, 1995

Related U.S. Application Data

[63] Continuation-in-part of Ser. No. 310,568, Sep. 22, 1994, Pat. No. 5,499,503.

[51] Int. Cl.[6] ..... F16D 31/02

[52] U.S. Cl. ..... 60/469; 60/493; 91/446

[58] Field of Search ..... 60/469, 468, 460, 60/464, 466, 493; 91/444, 445, 446

[56] References Cited

U.S. PATENT DOCUMENTS

| | | | |
|---|---|---|---|
| 5,101,630 | 4/1992 | Wagenseil | 60/460 |
| 5,159,813 | 11/1992 | Yoshimatsu et al. | 60/468 X |
| 5,259,293 | 11/1993 | Brunner | 60/468 X |
| 5,361,584 | 11/1994 | Langen et al. | 60/468 X |

FOREIGN PATENT DOCUMENTS

| | | | |
|---|---|---|---|
| 0024210 | 2/1980 | Japan | 60/460 |
| 2261901 | 10/1990 | Japan | 60/460 |

*Primary Examiner*—Hoang Nguyen

*Attorney, Agent, or Firm*—Wood, Phillips, VanSanten, Clark & Mortimer

[57] ABSTRACT

Roughness or jerkiness in a hydraulic swing circuit in an implement having a plurality of control circuits each having a work performing device (28), (30), (32) including a swing circuit having a hydraulic motor (32), which when under an aiding load may function as a pump, is avoided in a construction that includes a source (10) of hydraulic fluid under pressure and a plurality of control valves (22), (24), (26) for the circuits which are interconnected between the source (10) and the associated work performing device (28), (30), (32). The system includes a pair of hydraulic conduits (34), (36) extending from the control valve (26) for the swing circuit to the hydraulic motor (32). A pair of pilot operated, dual level pressure relief valves (56), (58) are connected oppositely across the conduits (34), (36) at a location between the control valve (26) for the swing circuit and the hydraulic motor (32). A pair of pilot operated counter balance valves (48), (50) are provided, one in each of the conduits (34), (36) at a location between the control valve (26) for the swing circuit and the pressure relief valves (56), (58).

4 Claims, 1 Drawing Sheet

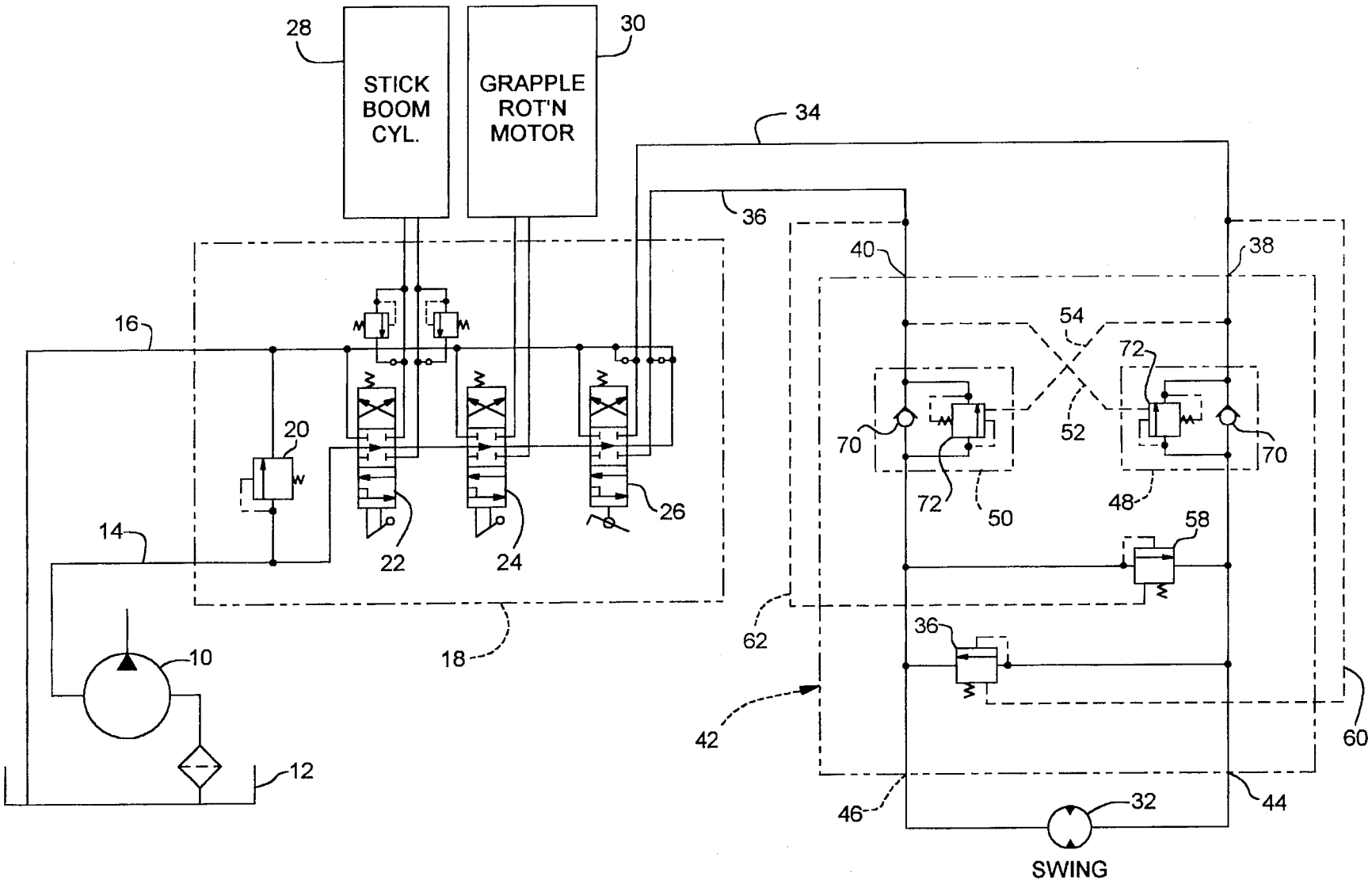
GRAPPLE ROT'N MOTOR
STICK BOOM CYL.
SWING
10
12
14
16
18
20
22
24
26
28
30
32
34
36
38
40
42
44
46
48
50
52
54
58
60
62
70
72

HYDRAULIC SWING CIRCUIT

CROSS-REFERENCE

This application is a continuation-in-part of my commonly assigned, application Ser. No. 08/310,568, filed Sep. 22, 1994, and entitled "HYDRAULIC SWING CIRCUIT", now U.S. Pat. No. 5,499,503.

FIELD OF THE INVENTION

This invention relates to hydraulic circuits, and more particularly, to a swing circuit such as is used in crane type devices such as log loaders or in excavators such as back hoes.

BACKGROUND OF THE INVENTION

Many types of work performing apparatus include booms or arms that are pivotal about an axis so as to be readily maneuverable to a desired location. Motors are utilized to pivot the boom about such axis and in a large number of cases, the motors employed are hydraulic motors. The circuit used to control the operation of such motors is referred to as the "swing circuit" because it operates to cause the boom to swing about the aforementioned axis.

In the usual case, the swing circuit receives hydraulic fluid under pressure from a hydraulic pump. Typically, other hydraulic circuits are also powered by the same pump. Such circuits may include a circuit for controlling a grapple or a bucket, a circuit for controlling the relation of an outer boom to an inner boom in a two part boom construction, etc.

In operation of such devices, a performance drawback is in the swing circuit. Typically, many of these types of apparatus have a swing system whose operation is extremely rough and jerky. This unevenness in operation is particularly apparent during a deceleration or aiding load situation.

If one considers the apparatus boom when it is initially stationary, and hydraulic fluid under pressure is applied to the swing motor to cause boom movement, the boom will begin to accelerate as it moves to a new position. As the new position is approached, the operator will halt the flow of hydraulic fluid to the motor to halt the boom. However, because the boom has mass and is moving, it contains a sizable quantity of kinetic energy due to inertia of the moving components.

Consequently, as hydraulic fluid is shut off to the hydraulic motor, the inertia in the system causes the boom to tend to continue to swing, resulting in a so-called aiding load situation which continues until the boom is fully decelerated to a halt. This, in turn, causes the hydraulic motor to function as a pump during the deceleration procedure.

If the hydraulic fluid now being pumped by the hydraulic motor is blocked, extremely high loadings on system components result. In some systems, the torque in the swing system upon deceleration can be as much as twice the torque during acceleration. As a consequence, all of the components of the swing system must be sized for the high deceleration torque which increases both component size and cost.

To avoid these problems, a variety of systems have been devised. In a very simple system, torque reliefs are located in the control valves to provide hydraulic braking as well as to protect the hydraulic motor during deceleration.

Most of these systems have met with some success. However, because swing systems are bi-rotational, that is, used to rotate a boom or the like in both directions around a pivot point, acceleration and deceleration pressures must be the same, and this necessitates "over building" to accommodate the high deceleration torque.

To overcome this difficulty, it has been proposed to use two stage dual level cross-over relief valves. This arrangement employs pilot operated pressure relief valves that are cross-connected across the swing motor. These valves are such that when they receive a pilot signal, they will open as pressure relief valves only at a relatively high pressure, whereas when no pilot signal is present, they will operate and open as pressure relief valves at a relatively low pressure.

These systems require a controller to select the pilot pressure to achieve the desired result and as a consequence, the expense of providing a controller is not conducive to a number of types of smaller, less expensive apparatus of the type having swing circuits.

Still other systems utilizing cross-connected two stage dual cross-over relief valves may utilize a manually operated control valve to control pilot pressure. For example, a foot operated valve might be utilized. While such systems are operative, they have the disadvantage of requiring additional hydraulic lines as well as excessive manual control effort.

In my above identified co-pending application, I have proposed a hydraulic swing circuit that is of a simple configuration and which provides an economical solution to the problems identified above. In one embodiment of the invention of my co-pending application, a pair of hydraulic conduits are provided to extend from the control valve to the hydraulic motor of the swing circuit. A pair of pilot operated relief valves are connected oppositely across the conduits and a pair of pilot operated check valves are provided, one in each of the conduits, at a location between the control valve and the relief valves. The pilots of the relief valves are connected to the conduit whose pressure is relieved by the associated relief valve at a location between the relief valve and the control valve while the pilot of each check valve is connected to the conduit in which the other check valve is located at a location between the check valve and the control valve. Each check valve is oriented in the associated conduit to allow flow from the control valve toward the hydraulic motor, but not the reverse, except when receiving a pilot signal.

As a consequence of this construction, upon deceleration, when the motor begins to act as a pump rather than a motor, the resultant lowering of pressure allows one of the relief valves to recirculate fluid back to the opposite side of the motor to provide fluid at low pressure levels for smooth deceleration.

Such a hydraulic swing circuit works well in the vast majority of instances. However, in one situation, there remains the possibility of a somewhat uneven operation.

Those skilled in the art will readily recognize that swing circuits of the type of concern are frequently employed with work performing devices such as loaders or back hoes that are mounted on vehicles. In most instances, outriggers are employed to maintain the vehicle in a level and stable position when the swing circuit is being operated. If, however, the base on which the swing circuit is mounted is not level, when the swing circuit is moving the work performing implement in the "down hill" direction, an aiding load situation occurs. That is to say, the weight of the work performing instrument and any load carried thereby, acts in addition to the hydraulic swinging force applied. As pumping action resulting from the aiding load increases, the check valve closes due to a drop in pressure at it's pilot, stopping the pumping action. Hydraulic fluid under pressure continues to be supplied via the control valve with the consequence that pressure in the opposite line increases causing the pilot to again open the check valve. Again, the aiding load causes the pump to act as a motor, driving hydraulic fluid through the check valve and causing a lowering in pressure at the pilot for the check valve. The resulting drop in pressure causes the check valve to close.

As can be readily appreciated, the situation is prone to cycling, causing uneven movement of the work performing device.

The present invention is directed to overcoming one or more of the above problems.

SUMMARY OF THE INVENTION

It is the principal object of the invention to provide a new and improved hydraulic swing circuit. More specifically, it is an object of the invention to provide a hydraulic swing circuit whose operation is smooth and which is of an inexpensive construction.

An exemplary embodiment of the invention achieves the foregoing object in a hydraulic system including a swing circuit having a hydraulic motor which, when under an aiding load, may function as a pump, along with a source of hydraulic fluid under pressure. A control valve is interconnected between the source and the hydraulic motor. The invention contemplates the provision of a pair of hydraulic conduits extending from the control valve to the hydraulic motor. A pair of pilot operated relief valves are connected oppositely across the conduits. A pair of pilot operated counter-balance valves are provided, one in each of the conduits, at a location between the control valve and the relief valves. The pilots of the relief valves are connected to the conduit whose pressure is relieved by the associated relief valve at a location between the relief valve and the control valve while the pilot of each counter-balance valve is connected to the conduit in which the other counterbalance valve is located at a location between the counterbalance valve and the control valve. Each counter-balance valve is oriented in the associated conduit to allow flow from the control valve toward the hydraulic motor, but not the reverse, except when receiving a pilot signal.

As a consequence of this construction, upon deceleration, when the motor begins to act as a pump rather than a motor, the resultant lowering of pressure allows one of the relief valves to recirculate fluid back to the opposite side of the motor to provide at low pressure levels for smooth deceleration.

In a highly preferred embodiment, the relief valves are dual level pressure relief valves which operate to relieve pressure at a high value when receiving a pilot signal and operate to relieve pressure at a relatively low pressure value when no pilot signal is being received.

In a highly preferred embodiment, the hydraulic system includes a plurality of control circuits, each having a work performing device, and a plurality of control valves, at least one for each circuit.

In one embodiment of the invention, the pressure relief valves and the counter-balance valves are disposed in a single valve body.

Other objects and advantages will become apparent from the following specification taken in connection with the accompanying drawings.

DESCRIPTION OF THE DRAWING

The FIGURE is a schematic of a hydraulic system, including a hydraulic swing system made according to the invention.

DESCRIPTION OF THE PREFERRED EMBODIMENTS

An exemplary embodiment of the invention is illustrated in the FIGURE and will be described in the environment of a log loader. However, it is to be understood that the invention in not restricted to use in log loader apparatus that may be utilized in any type of loader or excavator or other type of apparatus having a swing circuit.

The hydraulic system includes a hydraulic pump 10 which may be driven by any suitable prime mover (not shown). The pump 10 is connected to a sump 12 for receipt of make-up hydraulic fluid and provides high pressure hydraulic fluid on a supply line 14. A return line 16 extends to the sump.

The lines 14 and 16 extend to a control valve block 18 which may include an internal pressure relief valve 20 connected across the lines 14 and 16 and operative to dump high pressure fluid to the sump line 16 in the event a predetermined pressure level is exceeded.

Within the control valve block 18 are several control valves. In the embodiment illustrated there are three control valves including a stick boom control valve 22, a grapple rotation motor control valve 24, and a swing circuit control valve 26. These valves are all basically conventional and are manually operated as is well known. Each is a four-way valve and the valve 22 is connected to a work performing device such as the stick boom cylinder 28 of a log loader. Such a stick boom cylinder 28 will typically be a double acting cylinder as is well known.

The valve 24 is connected to a grapple rotation motor 30. The motor 30 is operative to rotate the log lifting grapple as is well known.

The valve 26 is connected to the swing circuit which includes a bi-directional, hydraulic motor 32 which is connected in a conventional fashion to pivot the boom of the log loader about a generally vertical axis.

To this end, a first conduit 34 extends from the valve 26 to one side of the motor 32 while a second conduit 36 extends from the valve 26 to the opposite side of the motor. As is well known, depending upon the position of the valve 26, the conditions at the conduits 34 and 36 may be altered. For example, when the valve 26 is centered, both of the conduits 34 and 36 will be blocked while if the valve 26 is shifted to the right or top as viewed in FIG. 1, pressurized fluid will be directed to the conduit 36 while the conduit 34 is connected to the sump 12 to cause the swing motor 32 to rotate in one direction. Alternatively, if the valve 26 is shifted downwardly or to the left from the position shown in FIG. 1, the line 34 will be connected to the high pressure line 14 and the conduit 36 connected to the sump 12.

The conduits 34 and 36 extend to ports 38 and 40 in a valve body, shown schematically at 42. The swing motor 32 is connected to ports 44 and 46 in the valve body 42. The ports 38 and 44 are connected together across a pilot operated counter-balance valve 48 within the body while the ports 40 and 46 are similarly connected across a pilot operated counter-balance valve 50. It will be noted that the pilot line 52 for the counter-balance valve 48 is connected to the port 40 whereas the pilot 54 for the counter-balance valve 50 is connected to the port 38. In essence, this means that the pilots 52 and 54 are connected to the downstream side of the control valve 26, i.e., connected to the conduits 34 and 36 at a location between the motor 32 and the control valve 26.

Cross-connecting the ports 44 and 46 are oppositely connected, dual level, pressure relief valves 56 and 58, both of which are pilot operated. The pressure relief valve 56 is constructed to relieve pressure ultimately from the line 34 while the pressure relief valve 58 is located so as to relieve pressure in the line 36.

As noted, both pressure relief valves 56 and 58 are dual level pressure relief valves. That is to say, when each receives an appropriate pilot signal, it will only relieve relatively high levels of pressure in the direction mentioned previously. Conversely, when no pilot signal is present, valves 56 and 58 are operative to relieve pressure at much lower pressure levels.

The pilot 60 for the pressure relief valve 56 is connected to the conduit for which the valve 56 is operative to relieve pressure, that is, the conduit 34. Similarly, the pilot 62 of the pressure relief valve 58 is connected to the line for which the valve 58 is operative to relieve pressure, that is, the conduit 36.

It will be observed that in both cases, the connection of the pilots 60 and 62 to the conduits 34 and 36 is upstream of the counter-balance valves 48 and 50 and downstream of the control valve 26.

Returning to the counter-balance valves 48 and 50, the same are conventional. Each includes an internal check valve 70 and an internal bypass valve 72 connected in bypass relation across the associated check valve 70. The bypass valve 72 is connected to the associated pilot 52 or 54 and is operative, upon receipt of an elevated pilot signal on the associated pilot to open in proportion to the relationship of the pilot pressure and the pressure at the downstream side of the associated check valve 70 to the pressure on the upstream side of the associated check valve 70. That is to say, the bypass valve 72 is operable to allow hydraulic fluid to flow from the upstream side of the associated check valve 70 to the downstream side 70 thereof in response to a pilot signal. It will also throttle such flow proportional to the pressure relationship just stated.

Thus, in contrast to pilot operated check valves as disclosed in my co-pending application, which are capable essentially of only off-on type reverse flow, the counter-balance valves 48 and 50 provide a throttled reverse flow across the associated internal check valve 70.

Operation is generally as follows.

If the control valve 26 is operated to provide pressure fluid to the line 34, the line 36 will be connected to the sump. High pressure fluid will flow into the port 38, through the counter-balance valve 48 and to the swing motor 32. The load on the swing motor will resist movement of the output of the latter and that in turn will result in a pressure rise on the line 34. This pressure rise will accomplish two things. For one, it will cause the pressure relief valve 56 to receive a pilot signal such that the same will only relieve pressure at a high pressure level. As a consequence, hydraulic fluid at high pressure is available to operate the swing motor 32 as is desired.

Simultaneously, high pressure in the line 34 will be directed via the pilot 54 to cause the counter-balance valve 50, and specifically, the internal bypass valve 72 thereof, to open proportionally to the pressure applied, thereby allowing spent hydraulic fluid to be throttled as it flows to the sump 12. At this time, the pressure relief valve 58 will not be receiving a pilot signal because the line 36 is effectively connected to the sump 12. As a result, the pressure relief valve 58 will be in it's low pressure setting and quite obviously, will not discharge fluid from the line 36 to the high pressure side of the system.

As a consequence, the high pressure hydraulic fluid will cause the swing motor 32 to operate in one direction of rotation.

When it is desired to halt the rotation of the swing motor 32, the operator will manually change the position of the valve 26. This will result in the cut-off of high pressure hydraulic fluid from the pump 10 to the conduit 34. At the same time, however, the load being operated by the swing motor, due to inertial effect, will continue to move and create a so-called aiding load situation which will cause the swing motor 32 to operate as a pump. If the base of the system is not level and the orientation of the components is such that the work performing device will tend to swing down hill, the gravitational force acting on the work performing device will likewise create a so-called "aiding load situation" which will cause the swing motor 32 to act as a pump.

Operation of the swing motor 32 as a pump will cause the same to seek make-up fluid from the port 44. This will result in a lowering of the pressure in the line 34. As a consequence, the pilot signal on the pilot 54 for the counter-balance valve 50 will be removed causing the internal bypass valve 72 to proportionally reduce flow therethrough. The pressure relief valve 58 will already be at it's low pressure setting and as a consequence, hydraulic fluid being pumped by the swing motor 32 to the port 36 may be directed to the port 44 through the pressure relief valve 58. Such direction of hydraulic fluid will continue until the inertial energy driving the swing motor 32 is sufficiently low that the pressure at the port 46 falls below the low pressure setting of the pressure relief valve 58. At this time, the pressure relief valve 58 will close.

During deceleration as described above, the counter-balance valves 48 and 50 are closed. They come into operation in the situation where the system is receiving hydraulic fluid under pressure from the control valve 26 and due to a non-horizontal disposition of the base (generally a vehicle) the force of gravity is aiding the swinging of the boom. Assume, for example, that the high pressure line is the line 34 with the line 26 being connected to the sump. Pressurized fluid will freely pass through the check valve 70 associated with the counter-balance valve 48 to drive the swing motor 32. At the same time, a high pressure signal will be placed on the pilot 54 of the counterbalance valve 50 causing the bypass valve 72 to open sufficiently to accommodate spent hydraulic fluid received from the motor 32 and passing to the sump 12.

In this situation, as gravity begins to create an aiding load situation, the pump 32 will begin to act as a motor, drawing in an even greater quantity of hydraulic fluid from the line 34, causing the pressure at the pilot 54 to drop. As a result of the lowering pilot pressure, the bypass valve 72 within the counterbalance valve 50 will begin to throttle down and close, thus increasing the back pressure applied to the motor 32. As a result, the motor 32 is not free to accelerate under the aiding load caused by gravity and the uneven operation that occurs as a result of off/on action of pilot operated check valves is avoided. Smoother operation results because of the fact that the internal bypass valve 72 provides a throttling action that is proportional to pilot pressure, and thus closely related to the degree of aiding load being encountered at any given time during operation of the system. Thus, the throttling action provided by the counter-balance valves 48 and 50 enhances the smoothness of operation of the system in the situation where the control valve 26 is directing pressurized fluid to the swing motor 32 and when the swing motor 32 is tending to act as a pump rather than a motor as a result of an aiding load resulting from gravitational effects. The counter-balance valves 48 and 50 function to throttle hydraulic fluid and cause a pressure rise in the high pressure line, resulting in what might be termed a "power down" situation.

The identical, but opposite action occurs if pressurized fluid is directed to the line 36 rather than the line 34.

In either event, it will be appreciated that high pressure hydraulic fluid is available to accelerate the swing motor 32 and maintain it's operation while only relatively low pressure fluid levels are present during deceleration or aiding load conditions because of the ability to use the dual limit pressure relief valves 56 and 58 and the provision of the counter-balance valves 48 and 50, respectively.

From the foregoing, it will be appreciated that a hydraulic swing circuit made according to the invention eliminates the roughness found in many prior art systems while at the same time accomplishes that object at a minimum of expense. Duplication of pumps and/or piping, and/or valves is completely avoided as is any need for sophisticated controllers.

I claim:

1. In a hydraulic system for an implement having a plurality of control circuits each having a work performing device and including a swing circuit having a hydraulic motor which, when under an aiding load, may function as a pump; a source of hydraulic fluid under pressure; a plurality of control valves, at least one for each circuit and interconnected between said source and the associated work performing device; the combination of:

a pair of hydraulic conduits extending from the control valve for said swing circuit to said hydraulic motor;

a pair of pilot operated dual level pressure relief valves connected oppositely across said conduits at a location between said control valve for said swing circuit and said hydraulic motor; and a pair of counter-balance valves, one in each of said conduits at a location between said control valve for said swing circuit and said pressure relief valves, said counter-balance valves each having a pilot and being oriented in the associated conduit to allow flow from said control valve for said swing circuit toward said hydraulic motor, but not the reverse, except when receiving a pilot signal;

the pilots of said pressure relief valves being connected to the conduit whose pressure is relieved by the associated pressure relief valve at a location between said pressure relief valves and said control valve for said swing circuit; and the pilot of each said counter-balance valve being connected to the conduit in which the other counter-balance valve is located at a location between said counter-balance valves and said control valve for said swing circuit.

2. The hydraulic system of claim 1 wherein said pressure relief valves and said counter-balance valves are disposed in a single valve body.

3. In a hydraulic system including a swing circuit having a hydraulic motor which, when under an aiding load, may function as a pump; a source of hydraulic fluid under pressure; a control valve interconnected between said source and said hydraulic motor; the combination of:

a pair of hydraulic conduits extending from the control valve to said hydraulic motor;

a pair of pilot operated relief valves connected oppositely across said conduits; and a pair of pilot operated counter-balance valves, one in each of said conduits at a location between said control valve and said relief valves, each said counter-balance valve being oriented in the associated conduit to allow flow from said control valve for said swing circuit toward said hydraulic motor, but not the reverse, except when receiving a pilot signal;

the pilots of said relief valves being connected to the conduit whose pressure is relieved by the associated relief valve at a location between said relief valves and said control valve; and the pilot of each said counter-balance valve being connected to the conduit in which the other counter-balance valve is located at a location between said counter-balance valves and said control valve.

4. In a hydraulic system including a swing circuit having a hydraulic motor which, when under an aiding load, may function as a pump, a source of hydraulic fluid under pressure; a control valve interconnected between said source and said hydraulic motor, the combination of a pair of hydraulic conduits extending from the control valve to said hydraulic motor;

a pair of pilot operated dual level pressure relief valves connected oppositely across said conduits; and a pair of pilot operated counter-balance valves, one in each of said conduits at a location between said control valve and said pressure relief valves, each said counter-balance valve being oriented in its associated conduit to allow flow from said control valve toward said hydraulic motor but not the reverse except when receiving a pilot signal;

the pilots of said pressure relief valves being connected to the conduit whose pressure is relieved by the associated pressure relief valve; and the pilot of each said counter-balance valve being connected to the conduit in which the other counter-balance valve is located at a location between said counter-balance valves and said control valve.

* * * * *